US005293818A

United States Patent [19]

Mandzuk

[11] Patent Number: 5,293,818

[45] Date of Patent: Mar. 15, 1994

[54] TRANSFER DEVICE, SUCH AS A PRINTER DEVICE

[76] Inventor: Raymond A. Mandzuk, 28 Warbeck Place, Etobicoke, Ontario, Canada, M9R 3C3

[21] Appl. No.: 57,779

[22] Filed: May 6, 1993

[51] Int. Cl.[5] ..... B41F 1/00

[52] U.S. Cl. ..... 101/287; 101/41; 101/333; 101/334

[58] Field of Search ..... 101/287, 310, 316, 318, 101/324, 163, 193, 202, 33, 34, 41, 93, 135.4, 333, 334

[56] References Cited

U.S. PATENT DOCUMENTS

| | | | |
|---|---|---|---|
| 451,978 | 5/1891 | Rott | 101/41 |
| 1,639,789 | 8/1927 | Walters | 101/41 |
| 1,657,237 | 1/1928 | Talbot | 101/41 |
| 1,688,470 | 10/1928 | O'Hara | 101/41 |
| 3,361,062 | 1/1968 | Proctor . | |
| 3,457,854 | 1/1969 | Marozzi . | |
| 3,487,776 | 1/1970 | Marozzi . | |
| 3,662,682 | 5/1972 | Marozzi . | |
| 3,797,390 | 3/1974 | Marozzi et al. . | |
| 3,804,016 | 4/1974 | Marozzi et al. . | |
| 3,878,776 | 4/1975 | Schneider | 101/41 |
| 3,949,851 | 4/1976 | Phelan . | |
| 4,004,511 | 1/1977 | de Groot | 101/334 |
| 4,066,131 | 11/1977 | Philipp | 101/41 |
| 4,220,085 | 9/1980 | Schott et al. | 101/287 |
| 4,365,554 | 12/1982 | Siegal et al. . | |
| 4,444,108 | 4/1984 | Jenness, III . | |
| 4,494,747 | 1/1985 | Graef et al. . | |
| 4,528,908 | 7/1985 | Davison et al. . | |
| 4,694,747 | 9/1987 | Marozzi | 101/333 |
| 4,760,788 | 8/1988 | Marozzi et al. | 101/333 |
| 4,805,529 | 2/1989 | Becher . | |
| 4,962,703 | 10/1990 | Bishop . | |

*Primary Examiner*—Eugene H. Eickholt
*Attorney, Agent, or Firm*—Ridout & Maybee

[57] ABSTRACT

A printer device has a print body on one end of which a print head is mounted, the print body being longitudinally movable along an inking stroke and a printing stroke, with the printing stroke being angularly offset by approximately 90° from the inking stroke, and with the print body being pivotally movable through an intermediate pivot stroke between the inking stroke and the printing stroke. A piston and cylinder assembly is connected to the print body for operatively causing advance movement of the print body along the inking stroke, the pivot stroke and the printing stroke, and return movement of the print body along the printing stroke, the pivot stroke and the inking stroke. The print body has a longitudinally elongated slot, and a fixed pivot pin is disposed in the elongated slot in the print body for guiding the print body, a first freely rotatable roller restraining the print body against pivotal movement during advance movement of the print body along the inking stroke. A channel in the print body is in alignment with the first roller at termination of the advance movement of the print body along the inking stroke whereby the print body undergoes advance movement along the pivot stroke during which the first roller passes through the channel in the print body. A second freely rotatable roller terminates the advance movement of the print body along the pivot stroke.

13 Claims, 6 Drawing Sheets

TRANSFER DEVICE, SUCH AS A PRINTER DEVICE

This invention relates to the provision of a transfer device, and is particularly although not exclusively concerned with the provision of a transfer device which constitutes a printer device by which ink applied to a print head incorporated in the device is transferred to, for example, a web of material which is operatively printed by the print head.

Such a printer device has previously been disclosed in, for example, U.S. Pat. No. 4,760,788 which issued on Aug. 2, 1988 to Marozzi et al. In this printer device of Marozzi et al, however, it is necessary for front and rear plates of the device to be provided with slotted cam tracks, and it is a primarily object of the present invention to provide a simplified transfer device such as a printer device in which such slotted cam tracks are not required.

According to the present invention there is provided a transfer device comprising a body having a longitudinal axis and having one end on which a head is adapted to be mounted, the body being longitudinally movable along a pick-up stroke and being longitudinally movable along a deposit stroke, with the deposit stroke being angularly offset from the pick-up stroke, and with the body being pivotally movable through an intermediate pivot stroke between the pick-up stroke and the deposit stroke. A power drive is connected to the body for operatively causing advance movement of the body along the pick-up stroke, the pivot stroke and the deposit stroke, and return movement of the body along the deposit stroke, the pivot stroke and the pick-up stroke. The body has a longitudinally elongated slot, and a fixed pivot pin is disposed in the elongated slot in the body for guiding the body, a first fixed abutment restraining the body against pivotal movement during advance movement of the body along the pick-up stroke under the influence of the power drive. A channel in the body is in alignment with the first abutment at termination of the advance movement of the body along the pickup stroke whereby the body under the influence of the power drive undergoes advance movement along the pivot stroke during which the first abutment passes through the channel in the body. A second fixed abutment terminates the advance movement of the body along the pivot stroke and restrains the body against pivotal movement during advance movement of the body along the deposit stroke under the influence of the power drive, the first abutment restraining the body against pivotal movement during return movement of the body along the deposit stroke under the influence of the power drive, at termination of the return movement of the body along the deposit stroke the body under the influence of the power drive undergoing return movement along the pivot stroke during which the first abutment passes through the channel in the body, and the return movement of the body along the pivot stroke being terminated by a third fixed abutment, with the second abutment restraining the body against pivot movement during return movement of the body along the pick-up stroke under the influence of the power drive.

In a preferred embodiment of the invention the transfer device may be constituted by a printer device with the head comprising a print head, and the pick-up stroke and deposit stroke being constituted by an inking stroke and a printing stroke, respectively.

In order that the invention may be more clearly understood and more readily carried into effect the same will now, by way of example, be more fully described with reference to the accompanying drawings in which FIG. 1 is a partially broken-away front view of a printer device according to a preferred embodiment of the invention;

FIG. 2 is a partially broken-away perspective of the printer device shown in FIG. 1;

FIGS. 3 to 8, inclusive, are front views to a reduced scale illustrating the printer device shown in FIG. 1 in various successive conditions during operative movement of the body of the printer device along the inking stroke, the pivot stroke, and the printing stroke, parts of the printer device being for clarity omitted in these views;

Figure 1:
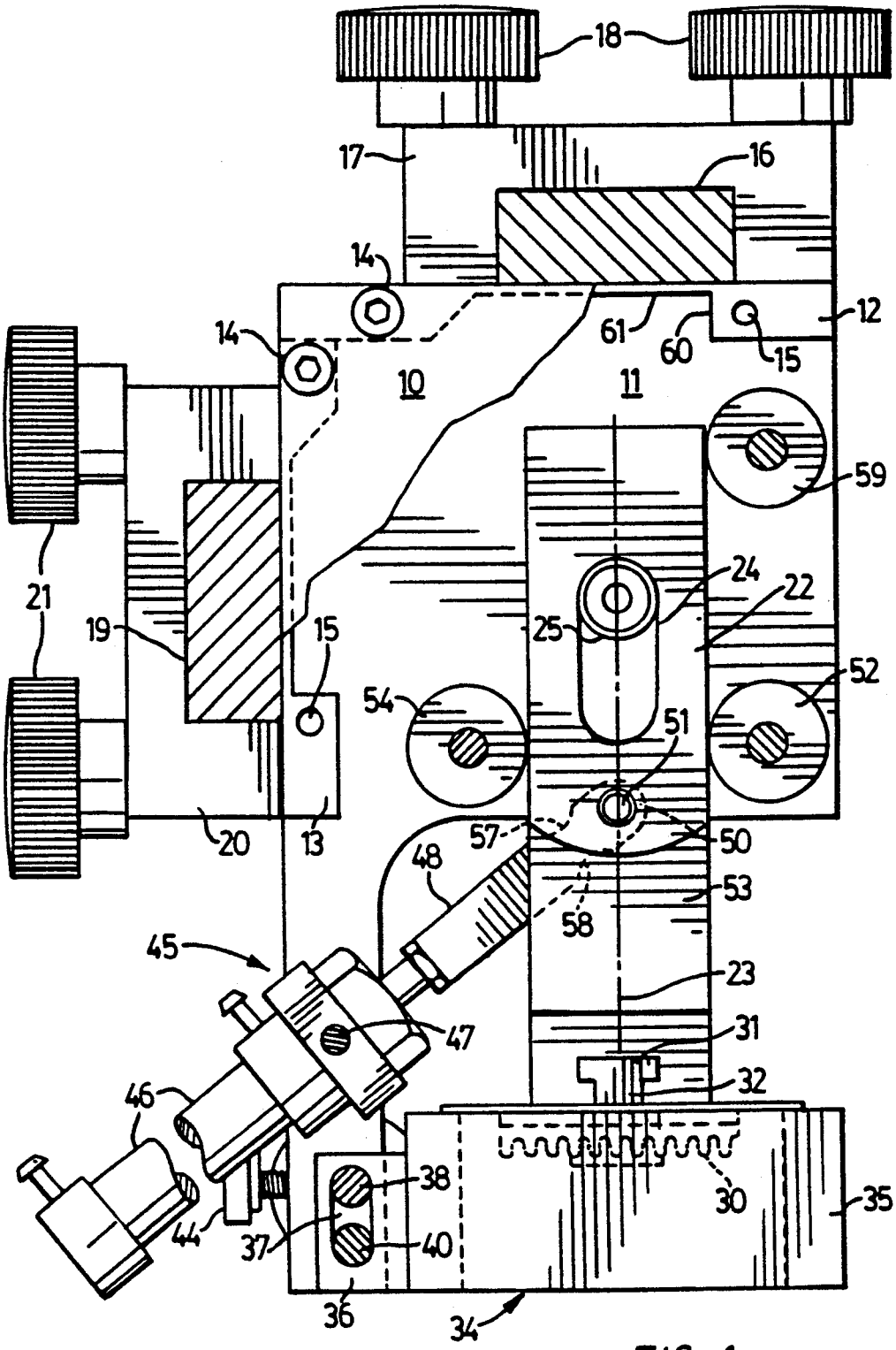
Figure 2:
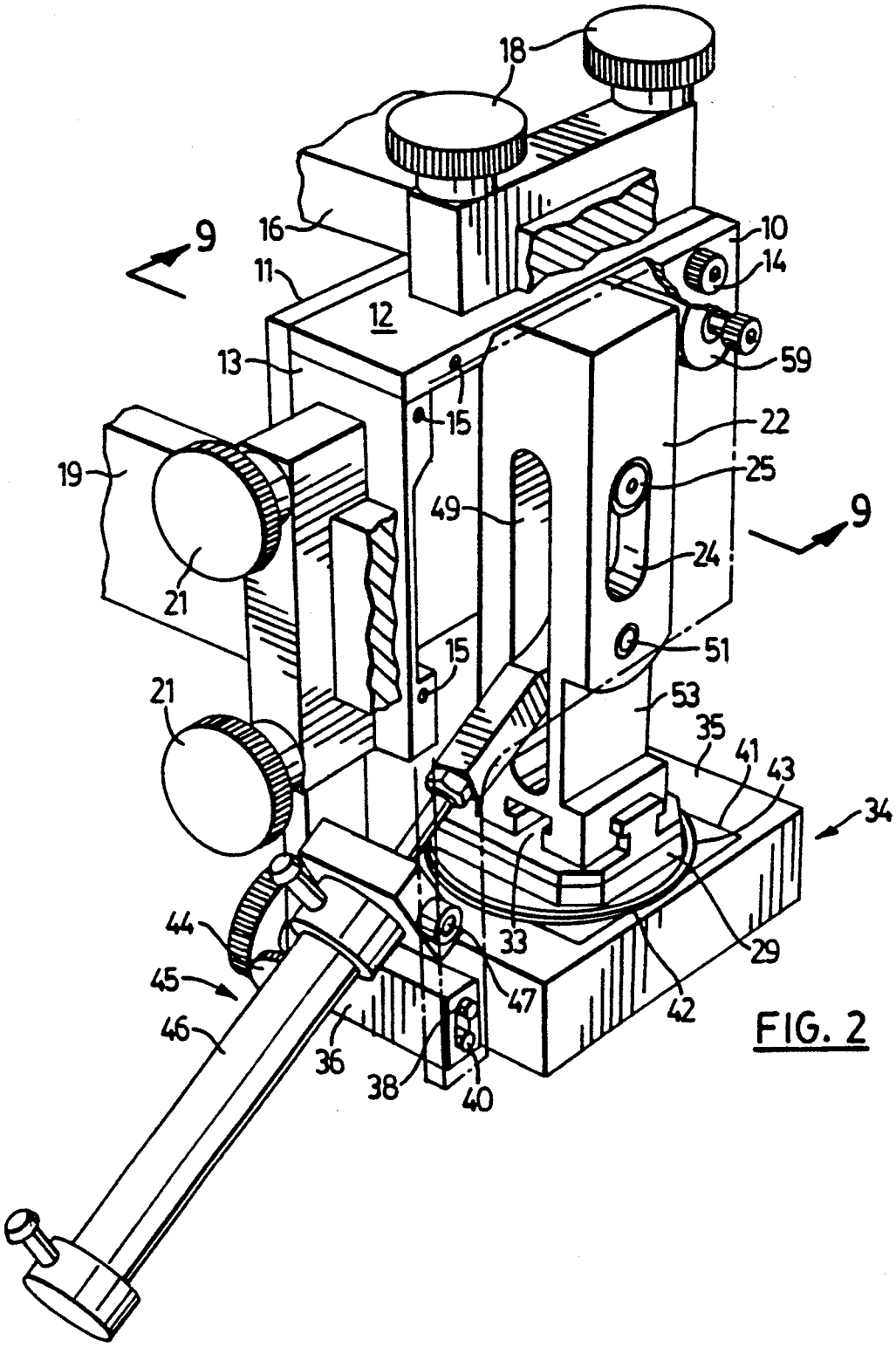

Referring to the drawings, the printer device comprises a front plate 10 and a rear plate 11 which are of corresponding inverted L-shaped form, only portions of the front plate 10 being shown in FIGS. 1 and 2, although in FIG. 2 the edges of the omitted portion of the front plate 10 are shown in chain-dotted lines. Furthermore, in FIGS. 3 to 8, inclusive, the front plate 10 is for clarity omitted in its entirety.

Disposed between and maintaining in spaced, parallel relationship the plates 10 and 11 are an upper plate 12 and a side plate 13, machines screws 14 securing the front plate 10 to the plates 12 and 13 with corresponding machine screws (not shown in FIG. 1) being screw-threadedly engaged in the holes 15 likewise to secure the front plate 10 to the plates 12 and 13. The rear plate 11 is correspondingly secured by machine screws (not shown) to the plates 12 and 13. The printer device is operatively mounted to an upper support bar 16 by a saddle member 17 secured by two screw-threaded members 18. Alternatively, or in addition, the printer device is operatively secured to a side support bar 19 by a saddle member 20 secured by two screw-threaded members 21.

Figure 9:
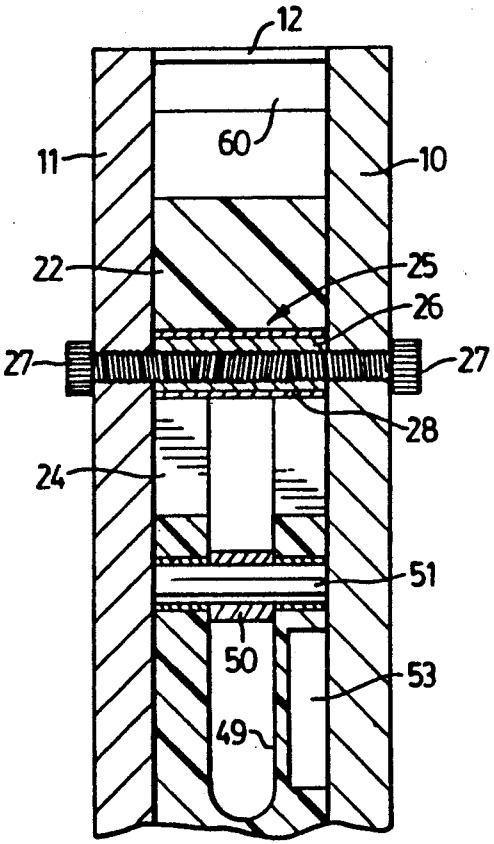
FIG. 9 is a sectioned view of a portion of the printer device on the line 9—9 in FIG. 2.

Slidably disposed between the plates 10 and 11 is a body 22 which is of generally rectangular parallelepiped form, the body 22 having a longitudinal axis 23 and having a longitudinally elongated slot 24, with a fixed pivot pin 25 being disposed through the slot 24 for operatively guiding the body 22. As is most clearly shown in FIG. 9, the pivot pin 25 may comprise an internally screw-threaded tube 26 disposed between the inner faces of the plates 10 and 11 and secured thereto by machine screws 27, a bushing 28 surrounding the tube 26.

At one end i.e. the lower end as viewed in FIGS. 1 and 2, of the body 22 there is operatively mounted thereon a print head 29, the face of which remote from the print body 22 is formed in relief with the indicia 30 to be printed. In the preferred embodiment of the invention shown in the drawings said one end of the body 22 has a keyhole slot 31 of T-shaped cross-section in which a rib 32 of corresponding configuration and which is presented by the print head 29 is slidably disposed for mounting of the print head 29 to the body 22. Said one end of the body 22 may be provided with a further slot 33 of keyhole configuration and which is disposed at right angles to the slot 31 so that, if desired, the print head 29 may alternatively be mounted at right angles on said one end of the to the body 22.

Figure 11:
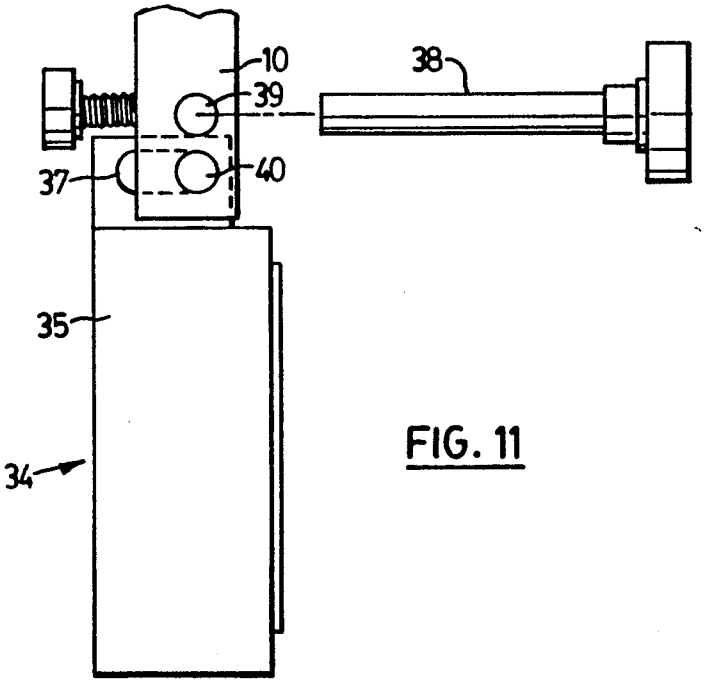
FIG. 11 is a front view corresponding to FIG. 10 of the further portion of the printer device shown therein, but in a different operative condition.

The printer device also comprises an inking assembly 34 having a support frame 35 with a laterally projecting portion 36 which is disposed between the plates 10 and 11, a vertically elongated slot 37 being provided in this portion 36 with a support pin 38 being removably disposed through the upper end portion of the slot 37 and through holes 39 in the plates 10 and 11, and a fixed pivot pin 40 extending between the plates 10 and 11 and through the slot 37 below the removable support pin 38. The frame 35 has a square opening 41 the sides of which have recesses 42 forming arcs of a circle. Thus, the opening 41 may support an ink pot of square form (not shown) or alternatively an ink pot 43 of circular form, the ink pot which may be of conventional form incorporating an ink saturated pad for applying ink to the relief indicia 30 on the print head 29 when the printer device is in the operative condition shown in, for example, FIGS. 1 and 2. By removing the support pin 38 the inking assembly 34 may be lowered vertically away from the print head 29 until the pivot pin 40 contacts the upper end of the slot 37 whereupon, under its own weight, the inking assembly 34 may be permitted to pivot about the pivot pin 40 to the position shown in FIG. 11 for, for example, replacement of the ink pot 43 within the inking assembly 34. A locking screw 44 may be screw-threadedly mounted in a side edge of the plate 10 or 11 for securing the support pin 38 against inadvertent removal. For convenience such a locking screw 44 may be so mounted in the side edge of each plate 10 and 11 so that, as desired, either of these locking screws 44 may be used.

A power drive is provided for operatively advancing the body 22, together with the print head 29, along an inking stroke, a pivot stroke, and a printing stroke, and returning the print body 22, together with the print head 29, along the printing stroke, the pivot stroke, and the inking stroke as is hereinafter more fully explained with particular reference to FIGS. 3 to 8, inclusive of the drawings, this power drive in the preferred embodiment of the invention illustrated in the drawings comprising a piston and cylinder assembly 45 which is pneumatically, or hydraulically, operated and which has a cylinder 46 one end of which is pivotally mounted between the plates 10 and 11 by trunnion bearings 47 with a piston rod 48 of the piston and cylinder assembly 45 extending into an elongated slot 49 in the body 22 and having a free end 50 pivotally mounted to the body 22 by a pivot pin 51 between the slot 24 and the print head 29. In alternative embodiments (not shown) of the invention the power drive may comprise, for example, a rack and pinion assembly or a rotary drive actuator having a pneumatically operated swivel vane. Such a rack and pinion assembly or rotary drive actuator may be of conventional form.

Figure 3:
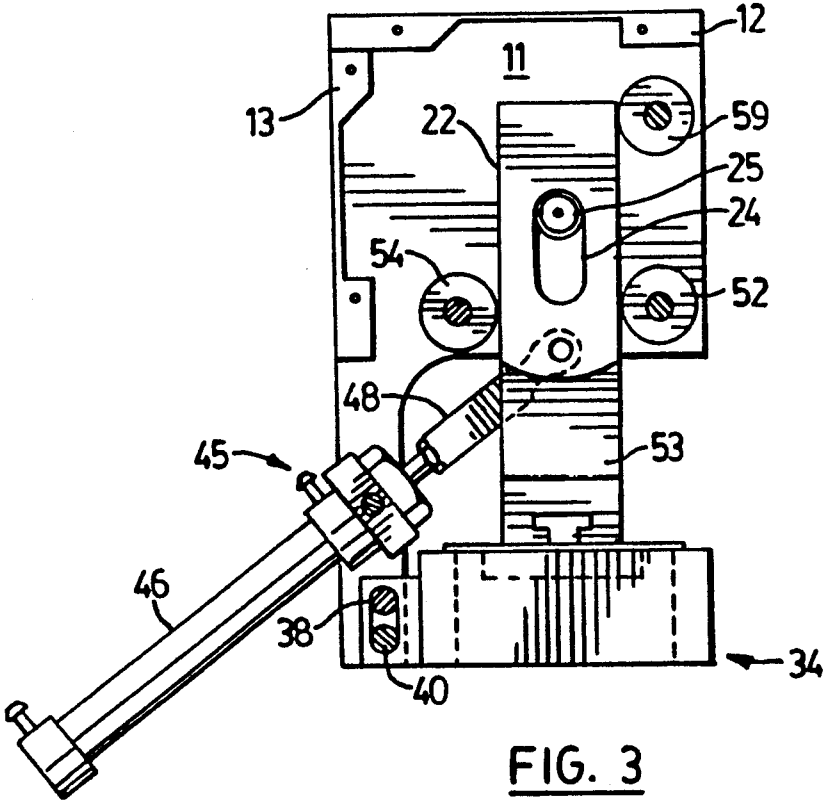

With the printer device in the condition shown in FIG. 3, and which is also the condition shown in FIGS. 1 and 2, the end of the slot 24 remote from the print head 29 is in abutting contact with the pivot pin 25, and the relief indicia 30 presented by the print head 29 has ink applied thereto from the ink pot 43. As pressurized fluid is admitted to the appropriate end portion of the cylinder 46 with the other end portion of the cylinder 46 being open to exhaust, the piston rod 48 is extended from the cylinder 46 thereby to apply a force to the body 22 at the pivot pin 51. This upwardly inclined force results in longitudinal upward movement of the body 22 along an inking stroke from the condition shown in FIG. 3 to the condition shown in FIG. 4, the body 22 during this longitudinal inking stroke being restrained against pivotable movement about the pivot pin 25 by a first fixed abutment which in the preferred embodiment is constituted by a freely rotatable roller 52 mounted on the inner face of the plate 10 about a fixed axis.

Figure 4:
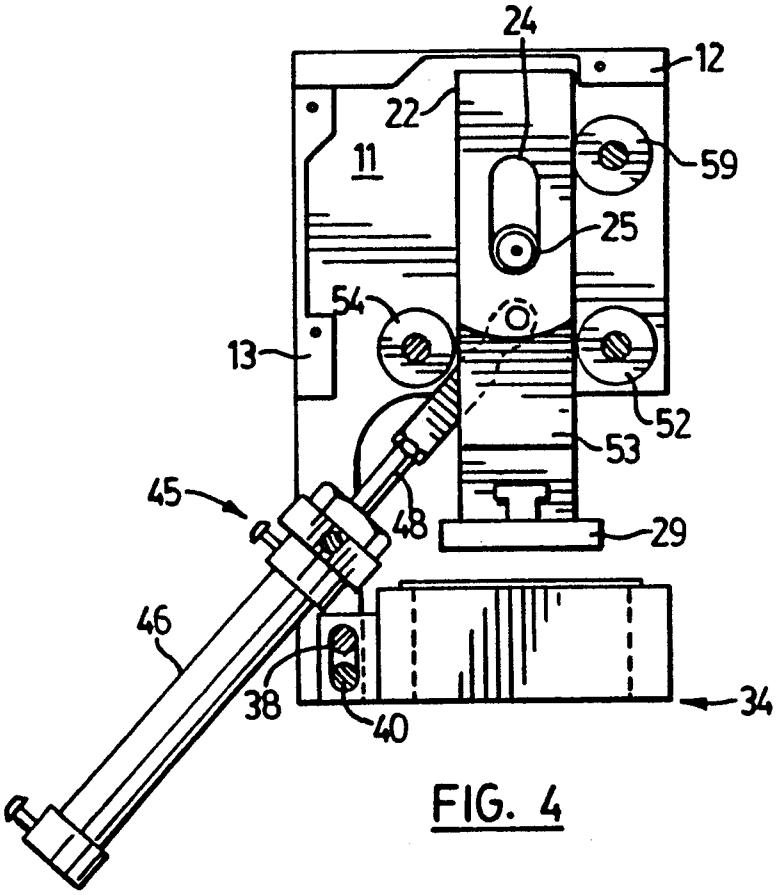
Figure 6:
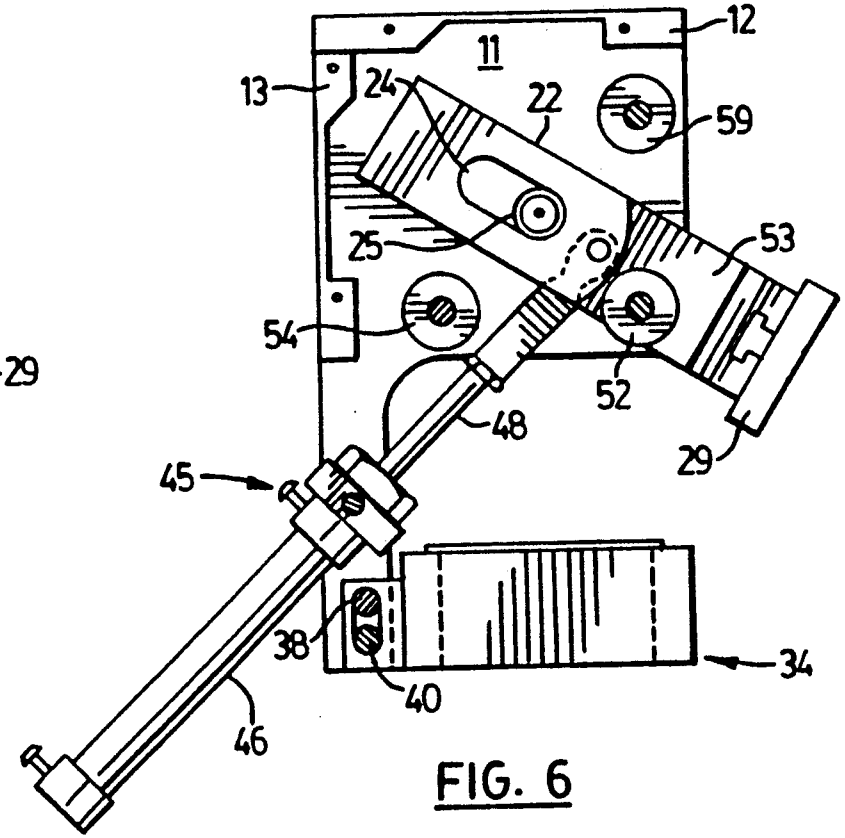
Figure 5:
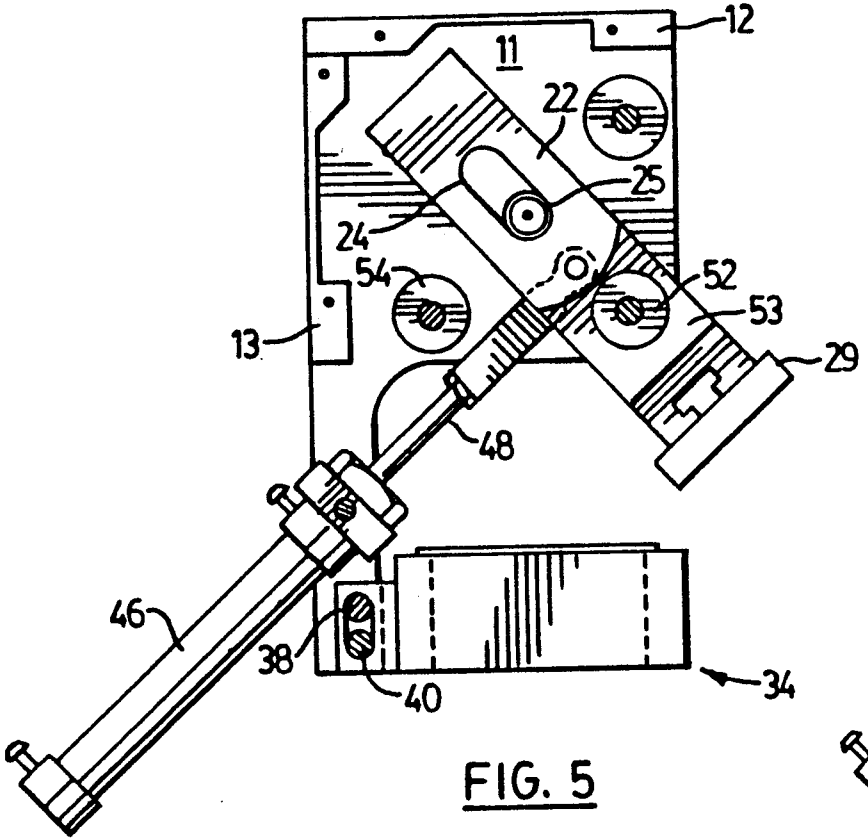

When the body 22 attains the condition shown in FIG. 4 further longitudinal upward movement of the body 22 is prevented by abutting contact of the opposed end of slot 24 with the pivot pin 25, continued extension of the piston rod 48 from the cylinder 46 resulting in pivotal advance movement of the body 22 about the pivot pin 25, with this pivotal movement of the body 22 being permitted by a clearance channel 50 in the front face of the body 22 and through which the roller 52 passes during this movement of the body 22 along the pivot stroke. This pivot movement of the body 22 along the intermediate pivot stroke, which is shown in FIGS. 5 and 6, continues until there is attained the condition shown in FIG. 7 in which a second fixed abutment comprising a freely rotatable roller 54 having a fixed axis abuts the body 22 to prevent further advance movement of the body 22 along the pivot stroke. Thereafter, continued extension of the piston rod 48 from the cylinder 46 results in longitudinal advance movement of the body 22 along a printing stroke to a condition shown in FIG. 8 in which the end of the slot 24 remote from the print head 29 is in abutting contact with the pivot pin 25 and the relief indicia 30 on the print head 29 prints on the web of material 55 to be printed and which is intermittently moved over a support structure 56. The printing stroke is angularly offset preferably at approximately 90° to the inking stroke.

While the edge of the clearance channel 53 remote from said one end of the body 22 is preferably arcuately curved the opposed edge of the channel 53 may, as shown in the drawings, be straight thereby to minimize any risk of the leading end of this opposed edge during advance movement of the body 22 along the pivot stroke becoming hooked against the inner edge of the front plate 10 particularly if there is slight misalignment of the piston rod 48.

Figure 7:
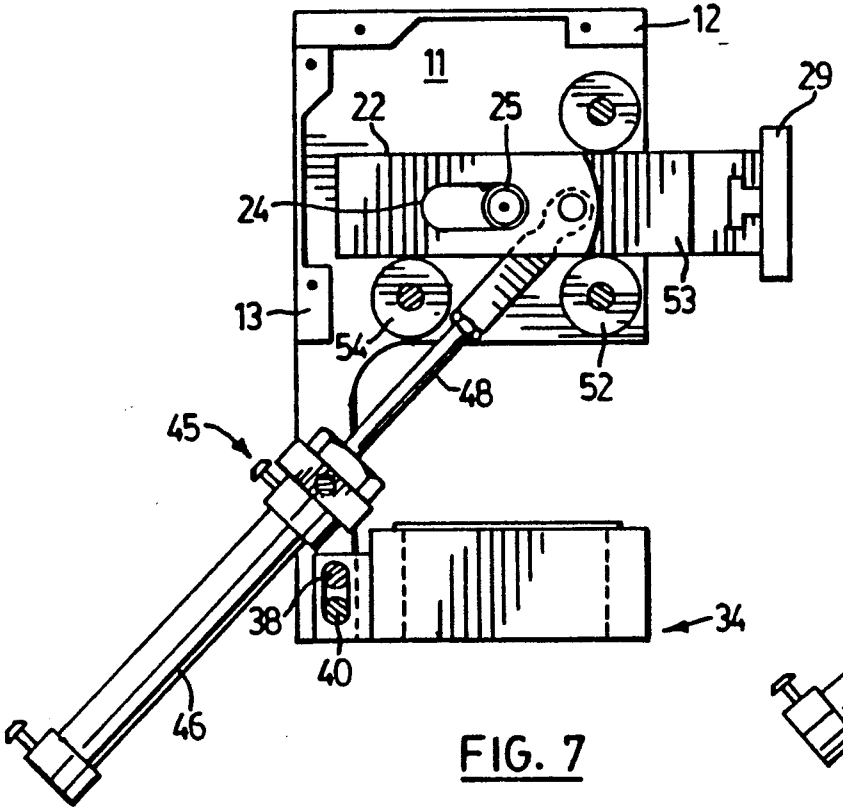
Figure 10:
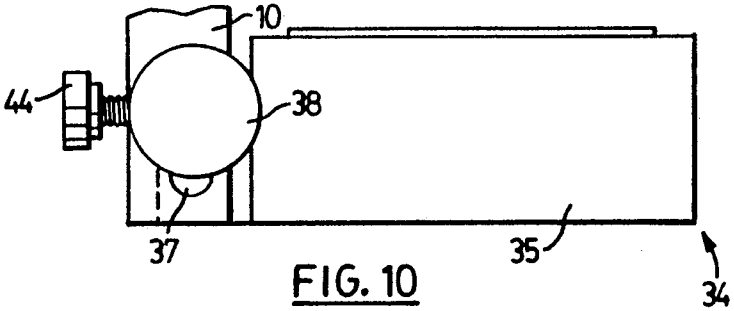
FIG. 10 is a front view of a further portion of the printer device shown in FIG. 1.

The appropriate side of the free end portion of the piston rod 48 is preferably provided with a recess 57 to prevent any interference of the piston rod 48 with the pivot pin 25 in the condition shown in FIG. 7. The opposed side of the free end portion of the piston rod 48 may be provided with a correspondingly positioned recess 58 so that it is immaterial which of these opposed sides of the free end portion of the piston rod 48 is uppermost when this free end portion is installed.

Figure 8:
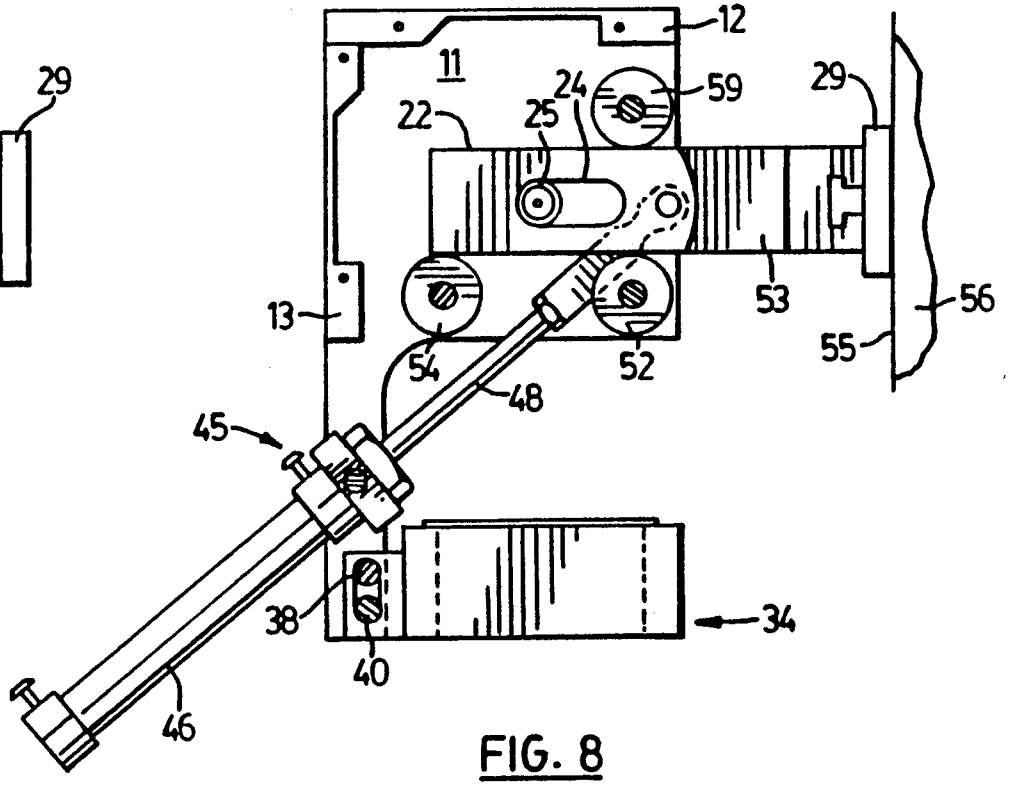

The pressurized fluid is then admitted to said other end portion of the cylinder 46, with the first-mentioned end portion of the cylinder being open to exhaust, to retract the piston rod 48 into the cylinder 46, with resultant return movement of the body 22 along the printing stroke from the condition shown in FIG. 8 to the condition shown in FIG. 7, and during which the body 22 is restrained against pivotal movement about the pivot pin 25 by the roller 52, this return movement of the body 22 along the printing stroke terminating when the appropriate end of the slot 24 abuts the pivot pin 25 at which condition the roller 52 is in alignment with the channel 53 so that continued retraction of the piston rod 48 into the cylinder 46 causes return movement of the print body 22 along the print stroke as shown in FIGS. 6 and 5. This return movement of the body 22 along the pivot stroke terminates when the body 22 contacts a third fixed abutment which also comprises a freely rotatable roller 59 having a fixed axis, with continued retraction of the pivot rod 48 into the cylinder 46 resulting in return movement of the body 22 along the inking stroke to the initial condition shown in FIG. 3, whereupon the cycle is repeated with the web of material 55 being advanced for printing thereon at a different position.

While in the preferred embodiment of the invention as hereinbefore described there is provided the roller 59, this roller 59 could be omitted with the shoulder 60 presented by a recess 61 in the upper plate 12 being appropriately positioned to terminate return movement of the body 22 along the pivot stroke by abutting contact of the body 22 with this shoulder 60. As the body 22 commences its return movement along the inking stroke from the condition shown in FIG. 4 towards the condition shown in FIG. 3 the body 22 will, of course, move out of abutting contact with the shoulder 60, but pivotal movement of the body 22 about the pivot pin 25 is then prevented by the roller 54 which is no longer in alignment with the channel 53.

The rollers 52, 54 and 59 may each be constituted by a brass ball bearing roller.

In the preferred embodiments of the invention hereinbefore described with reference to the accompanying drawings the transfer device is constituted by a printer device with the head comprising the print head 29, and the pick-up stroke and deposit stroke being constituted by an inking stroke and a printing stroke, respectively. However, in alternative embodiments (not shown) of the invention the transfer device may be for transferring, for example, labels seriatim from a vertical stack thereof for application to a substrate such as the web of material 55. In this case, the inking assembly 34 is replaced by an assembly for holding the vertical stack of the labels and the print head 29 is replaced by a head comprising a soft rubber vacuum cup by means of which the uppermost label in the vertical stack thereof is removed and is transferred for application to the web of material 55, a vacuum being applied to the vacuum cup during advance movement of the body 22 along the pick-up stroke, the pivot stroke, and the deposit stroke, with this vacuum being released when the label is applied to the web of material 55 and being re-applied only when the body 22 has completed its return movement along the deposit stroke, the pivot stroke, and the pick-up stoke for removal of the next label from the vertical stack thereof.

In further alternative embodiments (not shown) of the invention the print head 29 may be replaced by a robotics arm which may be of conventional form and which serves operatively to transfer articles during advance movement of the body 22 along the pick-up stroke, the pivot stroke, and the deposit stroke.

The embodiments of the invention in which an exclusive property or privilege is claimed are defined as follows:

1. A transfer device comprising:

a body having a longitudinal axis and having one end on which a head is adapted to be mounted, the body being longitudinally movable along a pick-up stroke and being longitudinally movable along a deposit stroke, with the deposit stroke being angularly offset from the pick-up stroke, and with the body being pivotally movable through an intermediate pivot stroke between the pick-up stroke and the deposit stroke, a power drive connected to the body for operatively causing advance movement of the body along the pick-up stroke, the pivot stroke and the deposit stroke, and return movement of the body along the deposit stroke, the pivot stroke and the pick-up stroke, a longitudinally elongated slot in the body, a fixed pivot pin disposed in the elongated slot in the body for guiding the body, a first fixed abutment restraining the body against pivotal movement during advance movement of the body along the pick-up stroke under the influence of the power drive, a channel in the body in alignment with the first abutment at termination of the advance movement of the body along the pick-up stroke whereby the body under the influence of the power drive undergoes advance movement along the pivot stroke during which the first abutment passes through the channel in the body, a second fixed abutment terminating the advance movement of the body along the pivot stroke and restraining the body against pivotal movement during advance movement of the body along the deposit stroke under the influence of the power drive, the first abutment restraining the body against pivotal movement during return movement of the body along the deposit stroke under the influence of the power drive, at termination of the return movement of the body along the deposit stroke the body under the influence of the power drive undergoing return movement along the pivot stroke during which the first abutment passes through the channel in the body, and the return movement of the body along the pivot stroke being terminated by a third fixed abutment, with the second abutment restraining the body against pivotal movement during return movement of the body along the pick-up stroke under the influence of the power drive.

2. A transfer device according to claim 1, wherein the elongated slot in the body has a first end remote from the said one end of the body, and an opposed second end, the first end of the elongated slot being in abutting contact with the pivot pin when the body is at the end of the pick-up stroke remote from the pivot stroke and when the body is at the end of the deposit stroke remote from the pivot stroke, and the second end of the elongated slot being in abutting contact with the pivot pin during operative movement of the body along the pivot stroke.

3. A transfer device according to claim 1, wherein the power drive comprises a piston and cylinder assembly having a cylinder pivotally mounted at a fixed location, and a piston rod having a free end pivotally mounted to the body between said one end thereof and the elongated slot therein.

4. A transfer device according to claim 3, wherein the piston rod has a side face provided with a recess to prevent operative interference of the piston rod with the fixed pivot pin.

5. A transfer device according to claim 4, wherein the piston rod has a further side face opposed to said side face, a correspondingly positioned recess being provided in said further side face.

6. A transfer device according to claim 1, wherein the angular offset of the deposit stroke from the pick-up stroke is approximately 90°.

7. A transfer device according to claim 1, wherein the first and second abutments each comprises a freely rotatable roller having a fixed axis.

8. A transfer device according to claim 7, wherein the third abutment comprises a freely rotatable roller having a fixed axis.

9. A transfer device according to claim 8, wherein the first, second and third abutments each comprises a brass ball bearing roller having a fixed axis.

10. A transfer device according to claim 1, wherein the transfer device is constituted by a printer device, with the head comprising a print head, and the pick-up stroke and deposit stroke being constituted by an inking stroke and a printing stroke, respectively.

11. A transfer device according to claim 10, further comprising a fixed support structure, and an inking assembly which is contacted by the print head thereby to apply ink thereto when the print body is at an end of the inking stroke remote f rom the pivot stroke, the inking assembly having a vertical slot, with a support pin removably disposed through an upper end portion of the vertical slot and through opening means in the support structure, and with a fixed pivot pin disposed through the vertical slot below the removable support pin.

12. A transfer device according to claim 11, wherein a locking screw is removably mounted in the support structure in locking engagement with the removable support pin.

13. A transfer device according to claim 11, wherein the inking assembly further comprises a support frame having a laterally projecting portion, the vertical slot being in the laterally projecting portion of the support frame, and the support frame having an opening which is square with sides thereof having recesses forming arcs of a circle, whereby the opening may accommodate a square or circular ink pot.

* * * * *